US008444424B2

(12) United States Patent
Shen et al.

(10) Patent No.: US 8,444,424 B2
(45) Date of Patent: May 21, 2013

(54) CARD EDGE CONNECTOR HAVING IMPROVED EJECTOR

(75) Inventors: Xue-Hai Shen, Kunshan (CN); Ting-Shun Liu, Kunshan (CN); Xue-Wu Bu, Kunshan (CN); Wen-Jun Tang, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/307,016

(22) Filed: Nov. 30, 2011

(65) Prior Publication Data

US 2012/0135618 A1 May 31, 2012

(30) Foreign Application Priority Data

Nov. 30, 2010 (CN) ..... 2010 2 0632916

(51) Int. Cl.
*H01R 13/62* (2006.01)

(52) U.S. Cl.
USPC ..... 439/153; 439/157

(58) Field of Classification Search
USPC ..... 439/152–160
See application file for complete search history.

(56) References Cited

U.S. PATENT DOCUMENTS

| | | | | |
|---|---|---|---|---|
| 5,634,803 | A * | 6/1997 | Cheng et al. | 439/157 |
| 5,662,485 | A * | 9/1997 | Yip et al. | 439/157 |
| 5,730,611 | A * | 3/1998 | Cheng et al. | 439/160 |
| 6,132,228 | A | 10/2000 | Lang | |
| 6,168,464 | B1 * | 1/2001 | Choy et al. | 439/567 |
| 6,250,938 | B1 * | 6/2001 | Tung | 439/160 |
| 6,551,116 | B1 * | 4/2003 | Liu | 439/79 |
| 6,979,206 | B2 * | 12/2005 | Bu et al. | 439/79 |
| 7,083,448 | B2 * | 8/2006 | Tanigawa | 439/160 |
| 7,484,978 | B1 * | 2/2009 | Gao | 439/160 |
| 7,938,657 | B2 * | 5/2011 | Tang et al. | 439/160 |
| 8,007,303 | B2 * | 8/2011 | Yao et al. | 439/153 |

* cited by examiner

*Primary Examiner* — Briggitte R Hammond
(74) *Attorney, Agent, or Firm* — Wei Te Chung; Ming-Chieh Chang

(57) ABSTRACT

A card edge connector (100) includes a longitudinal insulative housing (1), a set of contacts (2), and an ejector (3) rotatablely attached the insulative housing. The insulative housing has a longitudinal direction and a thickness direction, the insulative housing has a central slot (114). The contacts have contacting portions (21) arranged at two sides of the central slot (114) in the thickness direction. The ejector (3) includes a main portion (30), an ejecting portion (35) extending from a first end of the main portion and along the longitudinal direction, a locking portion (31) extending from a second end of the main portion opposite to the first end and along the longitudinal direction, and a lever portion (32) extending from the second end and along the thickness direction.

16 Claims, 7 Drawing Sheets

CARD EDGE CONNECTOR HAVING IMPROVED EJECTOR

BACKGROUND OF THE INVENTION

1. Field of the Invention

The present invention relates to a card edge connector, more particularly to a card edge connector having an improved ejector.

2. Description of Related Art

Card edge connectors are employed widely in computers to receive a memory module, graphic card, network interface et al. The card edge connector usually includes an elongated insulative housing defining a central slot for receiving the memory module, a plurality of contacts retained in the housing and projecting into the central slot for electrically mating with the memory module, and a pair of ejectors rotatablely attached to two longitudinal ends of the insulative housing for ejecting and latching with the memory module.

The ejectors usually have ejecting portions extending inwardly along a longitudinal direction for ejecting the memory module out of the central slot, locking portions extending inwardly along the longitudinal direction for latching with the memory module, and lever portions extending outwardly along the longitudinal direction and opposed to the locking portion for being operated by hands conveniently. However, the lever portions extend outwardly from the corresponding ejectors along the longitudinal direction, a total length of the card edge connector will be increased, and a space in the longitudinal direction the card edge connector occupied will be increased.

Hence, an improvement over the prior art is required to overcome the disadvantages thereof.

BRIEF SUMMARY OF THE INVENTION

According to one aspect of the present invention, a card edge connector comprises a longitudinal insulative housing, a plurality of contacts retained in the insulative housing, and an ejector rotatablely attached to one longitudinal end of the insulative housing for latching with or ejecting the memory module. The insulative housing defines a longitudinal direction and a thickness direction perpendicular to the longitudinal direction. The insulative housing has a central slot and extending along the longitudinal direction for insertion of a memory module. The contacts have contacting portions arranged at two sides of the central slot in the thickness direction and protruding into the central slot for mating with the memory module. The ejector comprises a main portion, an ejecting portion extending from a first end of the main portion and along the longitudinal direction for ejecting the memory module out of the central slot, a locking portion extending from a second end of the main portion opposite to the first end and along the longitudinal direction for latching with the memory module, and a lever portion extending from the second end and along the thickness direction to beyond the insulative housing so as to define an operating room beside the insulative housing along the thickness direction.

According to another aspect of the present invention, a card edge connector for being obliquely mounted onto a printed circuit board comprises a longitudinal insulative housing, a plurality of contacts retained in the insulative housing, and a pair of ejectors. The insulative housing has a central slot formed therein and extending in a longitudinal direction for insertion of a memory module, and a pair of tower portions formed at two sides of the central slot in the longitudinal direction and protruding forwardly. The contacts comprise contacting portions protruding into the central slot for mating with the memory module and tail portions extending downwardly for being mounted onto the printed circuit board. The ejectors are assembled to the tower portions respectively and pivoting at the tower portions toward the central slot. Each ejector comprises a main portion, an ejecting portion inwardly extending from the main portion and along the longitudinal direction for ejecting the memory module out of the central slot, a locking portion inwardly extending from the main portion and along the longitudinal direction for latching with the memory module, and a lever portion extending upwardly from the main portion beyond a top surface the insulative housing for facilitating urging the ejector.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENT

In the following description, numerous specific details are set forth to provide a thorough understanding of the present invention. However, it will be obvious to those skilled in the art that the present invention may be practiced without such specific details. In other instances, well-known circuits have been shown in block diagram form in order not to obscure the present invention in unnecessary detail. For the most part, details concerning timing considerations and the like have been omitted inasmuch as such details are not necessary to obtain a complete understanding of the present invention and are within the skills of persons of ordinary skill in the relevant art.

Figure 1:
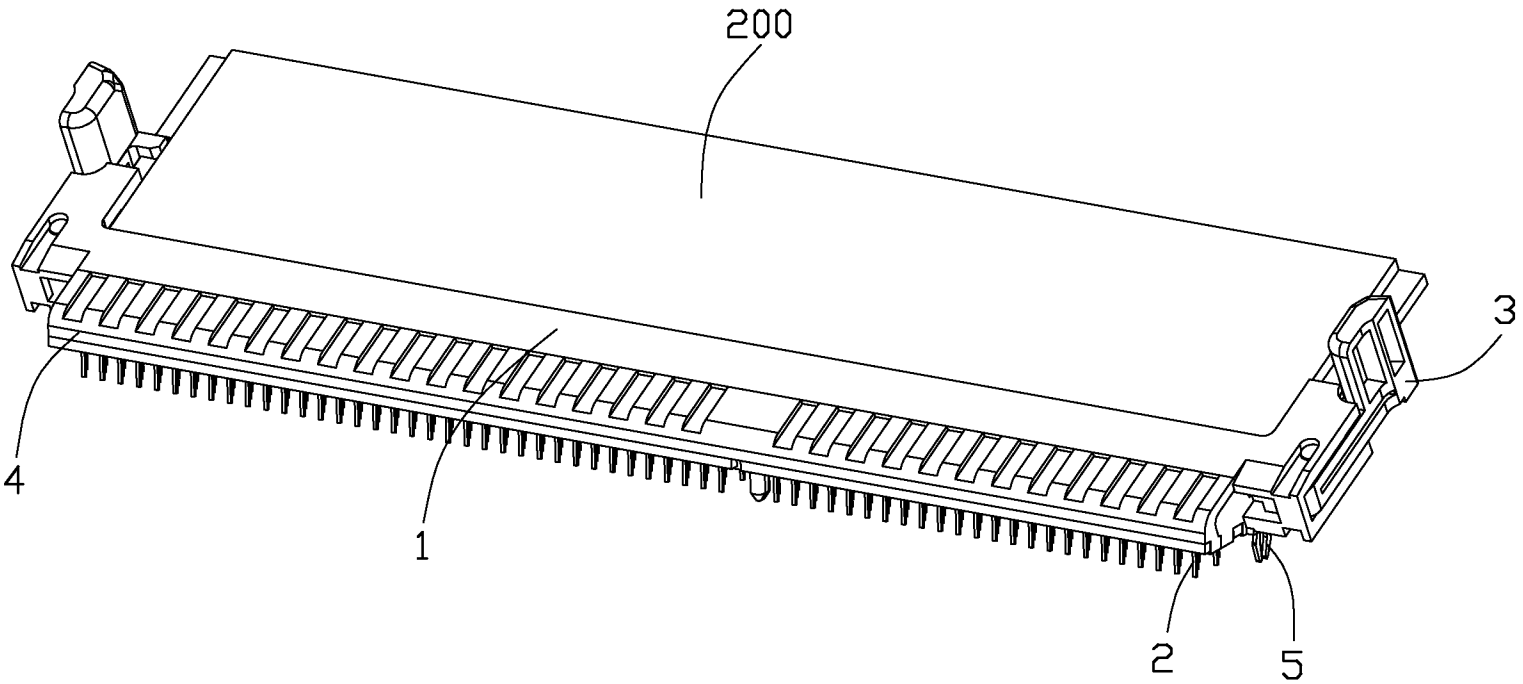
FIG. 1 is an assembled, perspective view of a card edge connector with a memory module inserted therein according to an embodiment of the present invention.
Figure 2:
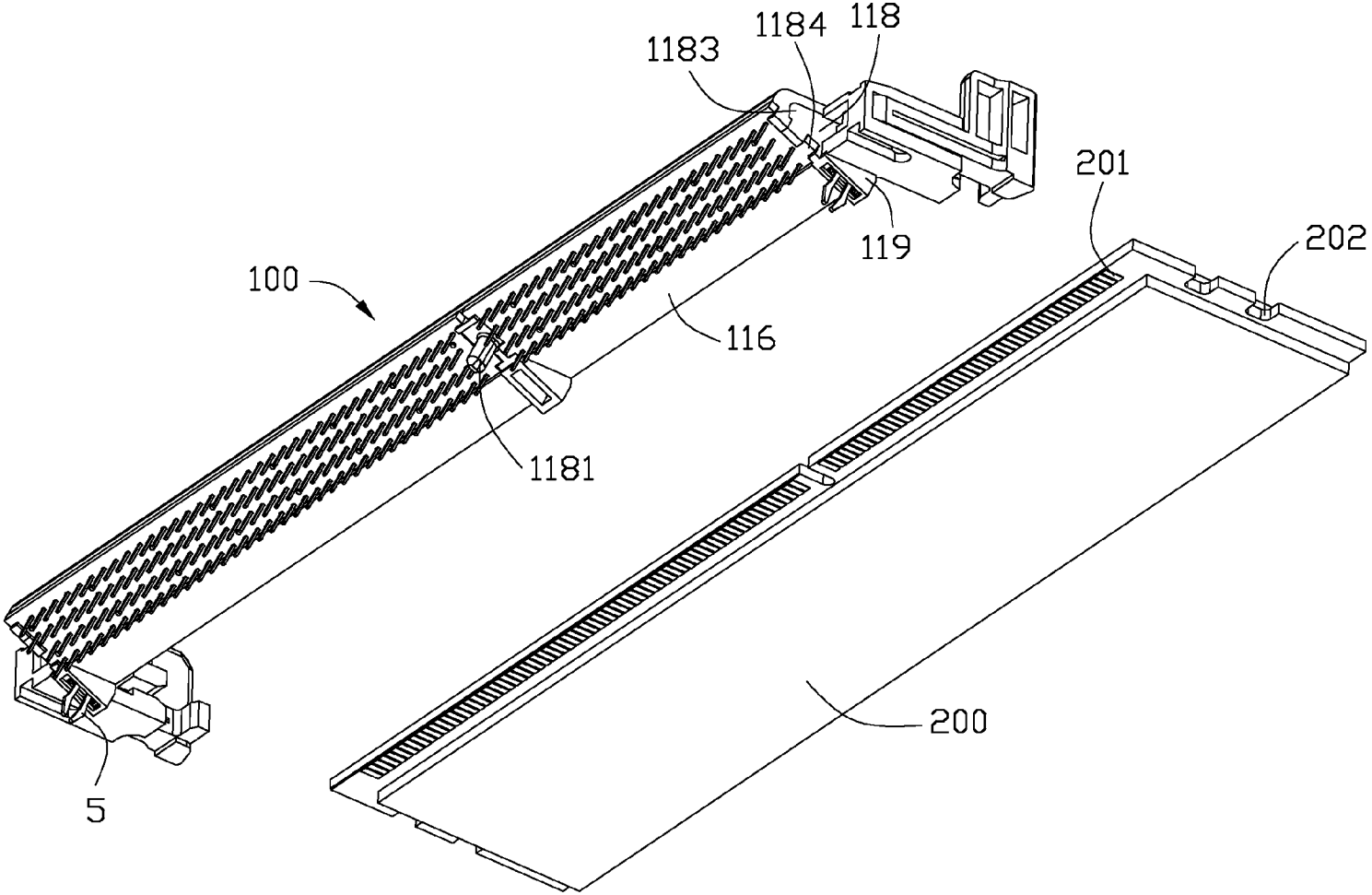
FIG. 2 is another perspective view of the card edge connector with the memory module separated therefrom shown in FIG. 1.
Figure 3:
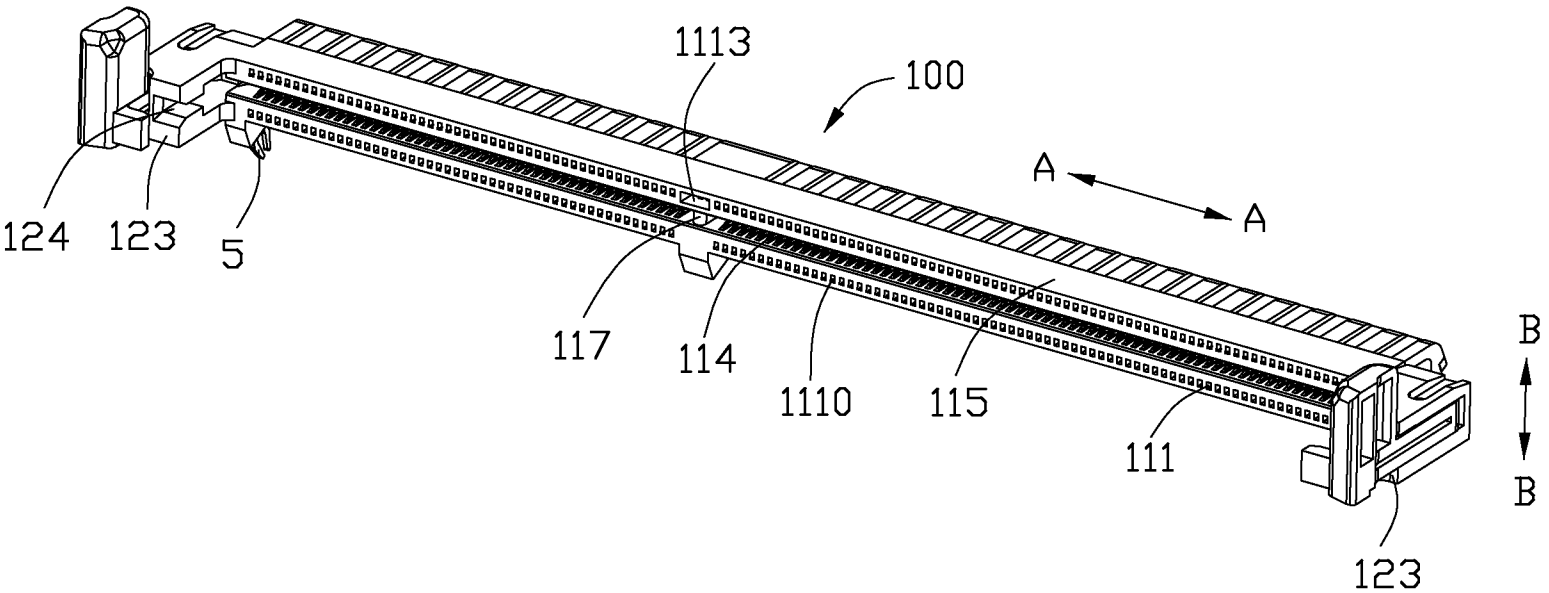
FIG. 3 is a perspective view of the card edge connector shown in FIG. 1.

Referring to FIGS. 1-3, a card edge connector 100 according to an embodiment of the present invention is used for being mounted onto a printed circuit board (not shown) in a scheduled angle and adapted for insertion of a memory module 200. The card edge connector 100 comprises a longitudinal insulative housing 1, a set of contacts 2 retained in the insulative housing 1, a pair of ejectors 3 located at two ends of the insulative housing 1 in a longitudinal direction A-A, and a positioning member 4 assembled to the insulative housing 1 for retaining the contacts 2.

Referring to FIGS. 2-5, the insulative housing 1 has a mating face 111 with a longitudinal central slot 114 recessed backwardly therefrom for insertion of the memory module 200, a back face 112 opposite to the mating face 111 in a front-to-back direction, an upper face 115, and a lower face 116 opposite to the upper face 115 in a height direction, that a thickness direction B-B of the insulative housing 1. The insulative housing 1 has a plurality of cavities 1110 located along two sides of the central slot 114 in the height direction and communicating with the central slot 114. The cavities 1110 pass through the mating face 111 and the back face 112 in the front-to-back direction. A protrusion 117 is located in a proper position of the central slot 114 so as to prevent the memory module 200 from mismating. The insulative housing 1 has a pair of tower portions 12 protruding forwardly from the two ends thereof and located at two sides of the central slot 114 in the longitudinal direction A-A, three protruding portions 118 protruding backwardly from the back face 112 and spaced apart from each other in the longitudinal direction A-A, and three mounting portions 119 protruding downwardly from the lower face 116 and corresponding to the three protruding portions 118 in the longitudinal direction A-A. Three board locks 5 are assembled to the mounting portions 1119 respectively so as to fasten the insulative housing 1 onto the printed circuit board. One of the three protruding portions 118 located between the other two protruding portions 118 has a post 1181 protruding downwardly from a lower face thereof for being retained into the printed circuit board and a dovetail slot 1182 recessed downwardly from an upper surface thereof. The other two protruding portions 118 have arc bumps 1183 formed at rear ends thereof and openings 1184 formed at lower surfaces thereof.

Each tower portion 12 has an inner face 121 facing the central slot 114, an outer face 122 opposite to the inner face 121 in the longitudinal direction A-A, and a front face 123 formed at a front side thereof. The tower portion 12 has a receiving slot 124 recessed from the inner face 121 and communicating with the central slot 114 for insertion of the memory module 200, and a chamber 125 recessed from the outer face 122 and communicating with the receiving slot 124 at a lower portion of the chamber 125. The tower portion 12 has a pair of upper and lower walls 126, 127 at two sides of the chamber 125 in the height direction, a pair of locking slots 128 formed at an inner side of the upper and lower walls 126, 127 respectively, and a pair of pivoting slots 129 formed at the upper and lower walls 126, 127 and located behind the locking slots 128.

The contacts 2 have contacting portions 21 received in the cavities 1110 respectively and protruding into the central slot 114 for mating with golden fingers 201 of the memory module 200, tail portions 22 extending downwardly and arranged in four rows in the front-to-back direction, and connecting portions 23 connecting the contacting portions 21 and the tail portions 22. The connecting portions 23 are arranged in two rows in the height direction.

Figure 4:
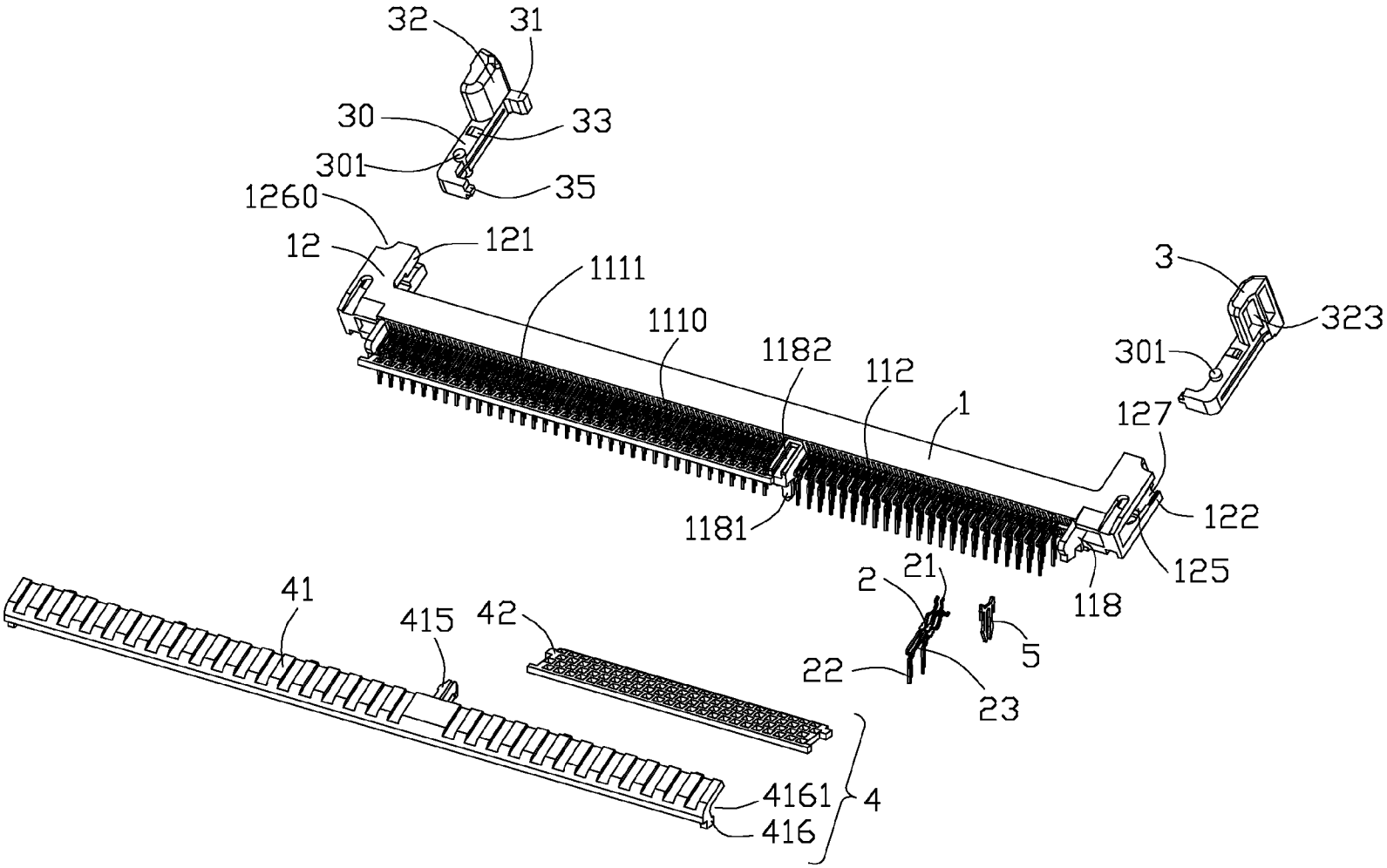
FIG. 4 is a partly exploded view of the card edge connector shown in FIG. 3.
Figure 5:
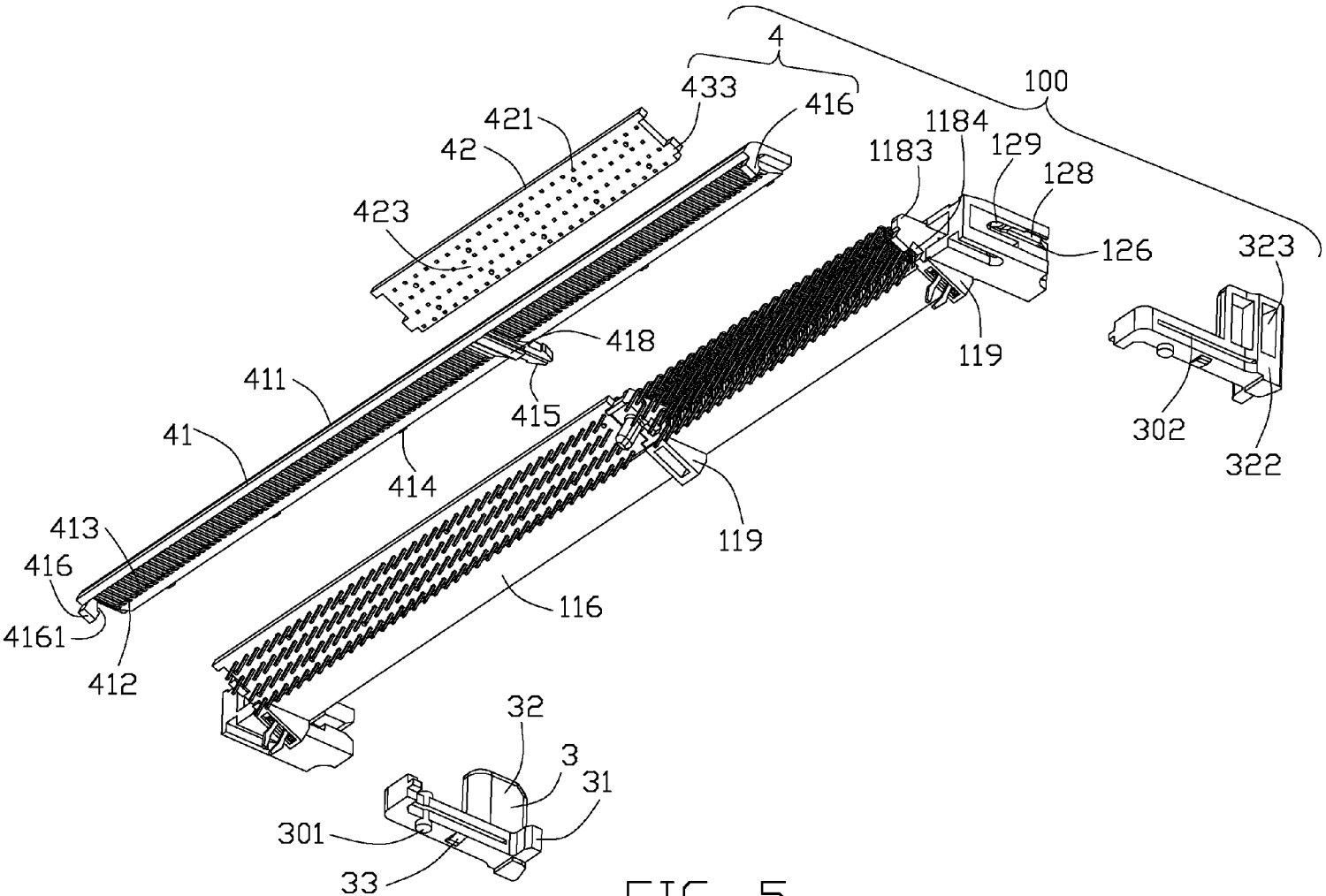
FIG. 5 is similar to FIG. 4, but viewed from another aspect.
Figure 6:
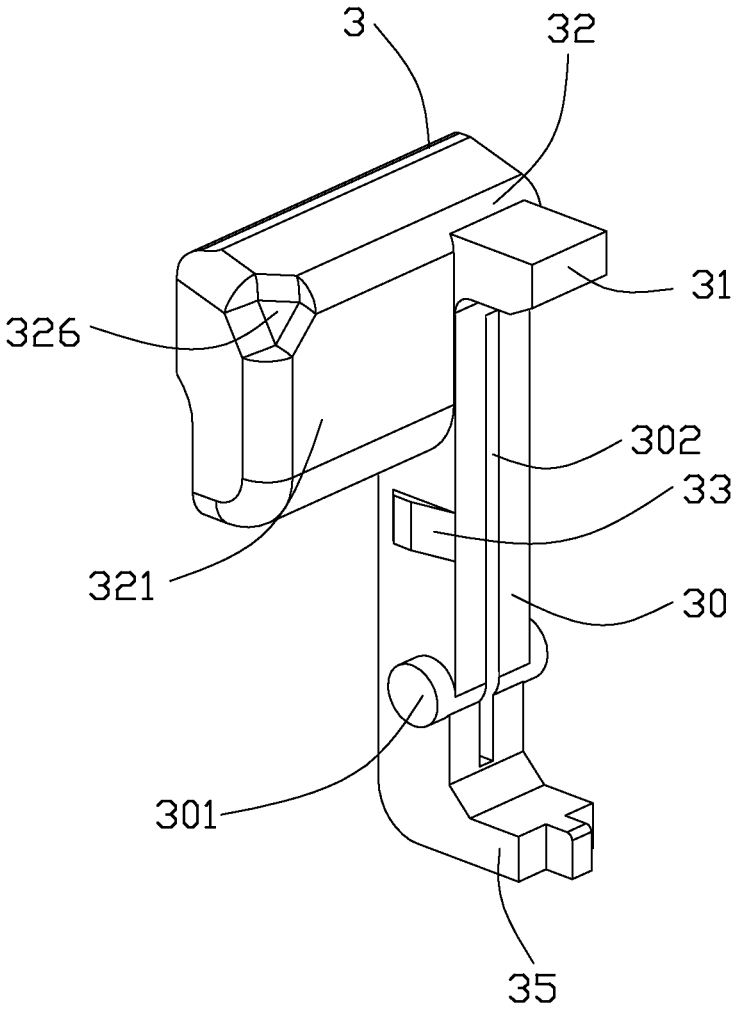
FIG. 6 is an enlarged perspective view of an ejector of the card edge connector shown in FIG. 3.
Figure 7:
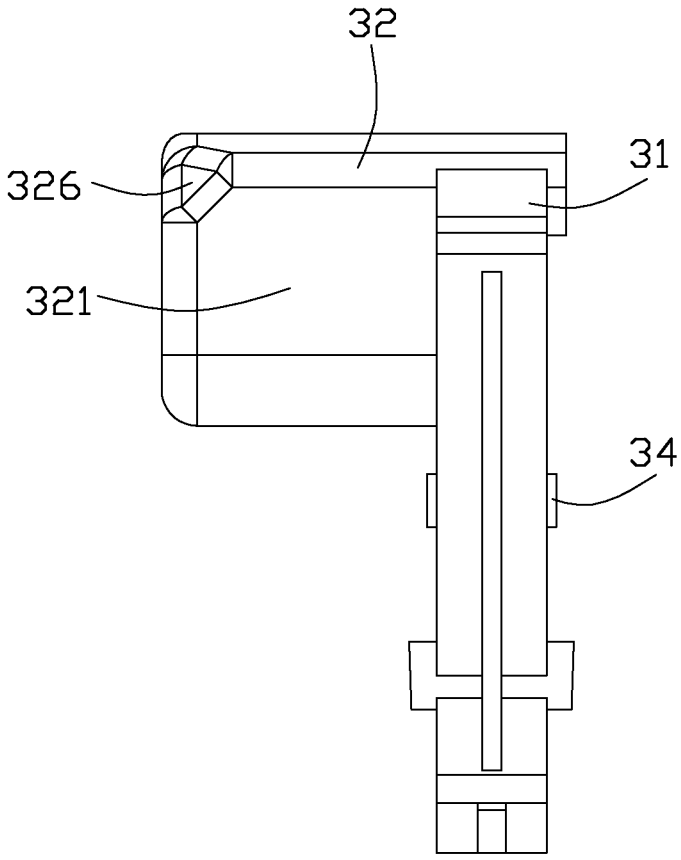
FIG. 7 is a side elevation view of the ejector shown in FIG. 6.

Referring to FIGS. 4-5, the positioning member 4 includes a cover 41 covering the connecting portions 23 and a pair of spacers 42 for retaining the tail portions 22. The cover 41 has a longitudinal body 411 formed with a plurality of ribs 412 extending in the front-to-back direction and a plurality of grooves 413 each formed between two adjacent ribs 412. The connecting portions 23 arranged in an upper row are retained in the grooves 413 respectively so that the connecting portions 23 of the upper row could be retained by the cover 41 firmly. The body 411 has a plurality of embossments 414 protruding forwardly for engaging with a plurality of notches 1111 formed in the back face 112 of the insulative housing 1, a locking member 415 for locking with a locking slot 1113 passing through the mating face 111 and the back face 112, a dovetail block 418 for being retained into the dovetail slot 1182, and a pair of retaining members 416 having arc slots 4161 for engaging with the arc bumps 1183. Each notch 1111 communicates with two adjacent cavities 1110 in the longitudinal direction A-A. Each spacer 42 has a pair of locking portions 433 at one end thereof for receiving the corresponding protrusion 118 and retaining member 416 together, a plurality of through holes 421 for the tail portions 22 passing through. The spacer 42 has a mounting face 423 disposed in a horizontal plane and formed a scheduled angle such as 25 or 30 degree with the lower face 116 of the insulative housing 1. Therefore, the card edge connector 100 is oblique relative to the printed circuit board.

Referring to FIGS. 4-7, each ejector 3 has a main portion 30 received in the chamber 125, an ejecting portion or kicker 35 extending from a back end of the main portion 30 in the longitudinal direction A-A for ejecting the memory module 200 out of the central slot 114, a locking portion or locker 31 extending from a front end of the main portion 30 in the longitudinal direction A-A for latching a cutout 202 of the memory module 200, and a lever portion or operation part 32 for being handled by a hand or others so as to operate the ejector 3 easily. The main portion 30 has a pair of spindles 301 formed at two sides thereof in the height direction and rotatablely received in the corresponding pivot slots 129 so that the ejector 3 could rotate relative to the insulative housing 1 toward the center of the central slot 114, and a pair of projections 33 formed at two sides thereof in the height direction and having interfering engagement with the locking slots 128 when the ejector 3 rotates relative to the insulative housing 1, and a through slit 302 extending along the main portion 30 to enhance its flexibility so that the ejector 3 could be assembled to the insulative housing 1 smoothly. The locking portion 31 extend inwardly from an inner side of a front end of the main portion 30, while the lever portion 32 extends upwardly from an upper side of the main portion 30 neighboring the inner side. Therefore, the space in the longitudinal direction A-A the card edge connector 100 occupied will be decreased. The lever portion 32 has a triangular notch 326 formed at an upper and front corner of an inner surface 321 thereof, and a pair of troughs 323 formed at an outer surface 322 thereof opposite to the inner surface 321 and extending to the main portion 30 in the height direction. The lever portion 32 has a thickness substantially same as that of the main portion 30 in the longitudinal direction A-A. The triangular notch 326 is smoothly chamfered with corresponding edges of the lever portion 32 so that the lever portion 32 could be handled by hand easily and harmlessly. The lever portion 32 engages with a gap 1260 formed on a front end of the upper wall 126. In this embodiment, the lever portion 32 is perpendicular to the locking portion 31. It is also understood, in another alternative embodiment, the lever portion 32 could extend obliquely relative to the locking portion 31.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A card edge connector comprising:

a longitudinal insulative housing defining a longitudinal direction and a thickness direction perpendicular to the longitudinal direction, the insulative housing having a central slot extending along the longitudinal direction for insertion of a memory module;

a plurality of contacts retained in the insulative housing, the contacts having contacting portions arranged at two sides of the central slot in the thickness direction and protruding into the central slot for mating with the memory module; and an ejector rotatablely attached to one longitudinal end of the insulative housing for latching with or ejecting the memory module, the ejector comprising a main portion, an ejecting portion extending from a first end of the main portion and along the longitudinal direction for ejecting the memory module out of the central slot, a locking portion extending from a second end of the main portion opposite to the first end and along the longitudinal direction for latching with the memory module, and a lever portion extending from the second end and along the thickness direction to beyond the insulative housing so as to define an operating room upwardly beside the insulative housing along the thickness direction; wherein the lever portion extends from only one side of the second end along said thickness direction with a distance not less than a width dimension of said main portion in said thickness/transverse direction so as to be asymmetrical with the main portion of the ejector.

2. The card edge connector according to claim 1, wherein the lever portion is perpendicular to the locking portion.

3. The card edge connector according to claim 1, wherein the lever portion is oblique to the locking portion.

4. The card edge connector according to claim 1, wherein the lever portion has a dimension substantially same as that of the main portion in the longitudinal direction.

5. The card edge connector according to claim 1, wherein the insulative housing has a tower portion formed at one longitudinal end thereof, the tower portion has a receiving slot facing and communicating with the central slot, a chamber opposed to the receiving slot for receiving the main portion, a pair of pivoting slots formed at two sides of the chamber in the thickness direction, the main portion has a pair of spindles rotatablely received in the corresponding pivoting slots so that the ejector could rotate toward the central slot relative to the insulative housing.

6. The card edge connector according to claim 5, wherein the tower portion has a gap formed at one end thereof and communicating with the chamber, the lever portion engages with the gap.

7. The card edge connector according to claim 1, wherein the lever portion has a triangular notch formed at a corner of an inner surface thereof and smoothly chamfered with edges of the lever portion.

8. The card edge connector according to claim 7, wherein the lever portion has a pair of troughs formed at an outer surface opposite to the inner surface and extending to the main portion in the thickness direction.

9. A card edge connector for being obliquely mounted onto a printed circuit board comprising:

a longitudinal insulative housing having a central slot formed therein and extending in a longitudinal direction for insertion of a memory module, and a pair of tower portions formed at two sides of the central slot in the longitudinal direction and protruding forwardly;

a plurality of contacts retained in the insulative housing and comprising contacting portions protruding into the central slot for mating with the memory module, and tail portions extending downwardly for being mounted onto the printed circuit board; and a pair of ejectors assembled to the tower portions respectively and pivoting at the tower portions toward the central slot, each ejector comprising a main portion, an ejecting portion inwardly extending from the main portion and along the longitudinal direction for ejecting the memory module out of the central slot, a locking portion inwardly extending from the main portion and along the longitudinal direction for latching with the memory module, and a lever portion extending upwardly from the main portion beyond a top surface of the insulative housing for facilitating urging the ejector; wherein the lever portion has a triangular notch formed at an upper and front corner of an inner surface thereof and smoothly chamfered with edges of the lever portion.

10. The card edge connector according to claim 9, wherein the lever portion is perpendicular to the locking portion.

11. The card edge connector according to claim 9, wherein the lever portion is oblique to the locking portion.

12. The card edge connector according to claim 9, wherein each tower portion has a receiving slot facing and communicating with the central slot, a chamber opposed to the receiving slot for receiving the main portion, a pair of pivoting slots formed at two sides of the chamber, and a gap formed at an upper and front end thereof and communicating with the chamber for the lever portion engaging with, the main portion has a pair of spindles rotatablely received in the corresponding pivoting slots.

13. The card edge connector according to claim 1, wherein the lever portion has a pair of troughs formed at an outer surface opposite to the inner surface and extending downwardly to the main portion.

14. A card edge connector for use with an edge card, comprising:

an insulative housing defining therein a central slot extending along a longitudinal direction, said central slot extending through a mating face of the housing for communication with an exterior in a mating direction perpendicular to said longitudinal direction, for allowing said edge card to be adapted to be inserted into the central slot;

a plurality of contacts disposed in the housing by two sides of the central slot in a transverse direction perpendicular to said longitudinal direction and said mating direction;

at least one ejector having an elongated body and pivotally, about a pivot axis extending in said transverse direction, mounted at one end of the housing in said longitudinal direction, said ejector defining a kicker located around an inner end of the elongated body and extending into an interior portion of the central slot far away from the mating face for engagement with a bottom end of the edge card, a locker located around an outer end of the elongated body and extending in the longitudinal direction for engagement within a notch located in a side edge of the edge card, and an operation part neighboring the locker and essentially primarily offset from said locking in said transverse direction for accessibility to a user to easily operate the ejector without interference with the corresponding edge card if the housing is slantingly or horizontally mounted on a printed circuit board wherein the operation part essentially extends from only an upper side of the elongated body in said transverse direction with a distance not less than a width dimension of said elongated body in said transverse direction so as to be asymmetrical with regard to the elongated body of the ejector.

15. The card edge connector as claimed in claim 14, wherein said operation part is essentially fully aligned with the elongated body in the transverse direction so as to reduce a dimension of the connector in the longitudinal direction.

16. The card edge connector as claimed in claim 14, wherein the elongated body of the ejector defines a slit extending therethrough in the longitudinal direction while the operation part defines a recess which does not extend therethrough in the longitudinal direction.

* * * * *